US010190735B1

(12) United States Patent
Tseng

(10) Patent No.: US 10,190,735 B1
(45) Date of Patent: Jan. 29, 2019

(54) LED DRIVER CIRCUIT AND METHOD

(71) Applicant: AMTAI MEDICAL EQUIPMENT, INC, Raleigh, NC (US)

(72) Inventor: Chih-Cheng Tseng, New Taipei (TW)

(73) Assignee: AMTAI MEDICAL EQUIPMENT, INC, Raleigh, NC (US)

( * ) Notice: Subject to any disclaimer, the term of this patent is extended or adjusted under 35 U.S.C. 154(b) by 0 days.

(21) Appl. No.: 15/886,168

(22) Filed: Feb. 1, 2018

(30) Foreign Application Priority Data

Jul. 4, 2017 (TW) ..... 106122362 A

(51) Int. Cl.
*H05B 33/08* (2006.01)
*F21S 4/10* (2016.01)

(52) U.S. Cl.
CPC ..... *F21S 4/10* (2016.01); *H05B 33/0842* (2013.01)

(58) Field of Classification Search
None
See application file for complete search history.

(56) References Cited

U.S. PATENT DOCUMENTS

2017/0339763 A1* 11/2017 Huang ..... F21K 9/238

* cited by examiner

*Primary Examiner* — Jany Richardson
(74) *Attorney, Agent, or Firm* — Locke Lord LLP; Tim Tingkang Xia, Esq.

(57) ABSTRACT

The present invention provides an LED driver circuit, comprising a voltage converter electrically connected to a power supply and an LED string, wherein the voltage converter provides a fixed voltage to the LED string; and a current-based light-adjusting unit electrically connected to the voltage converter, wherein the current-based light-adjusting unit controls the amplitude of the current flowing through the LED string, in an analog manner and based on a duty cycle of a pulse width modulation signal.

11 Claims, 2 Drawing Sheets

LED DRIVER CIRCUIT AND METHOD

CROSS-REFERENCE TO RELATED APPLICATION

This application claims the benefit of Taiwan Patent Application No. 1061223623, filed on Jul. 4, 2017, in the Taiwan Intellectual Property Office, the disclosure of which is incorporated herein in its entirety by reference.

BACKGROUND

Technical Field

The present invention relates to a driver circuit and method, particularly to an LED driver circuit and method.

Description of Related Art

Light emitting diodes (LEDs) are replacing conventional lighting technologies for their advantages including less power consumption, smaller sizes and low levels of pollution. Current LEDs are mainly driven with the dimming technique using pulse width modulation (PWM), and are thus caused to switch rapidly between zero-current state and full-current state at a rate dependent on the pulse wave frequency, which results in the flashing of LEDs. The LED flashes, though imperceptible to the human eye due to persistence of vision, tend to cause eye fatigue after prolonged hours of exposure to these lights. It matters in particular when it comes to LED-based surgical lighting systems. In the field of surgery where surgeons are often subject to long surgical procedures and the health of patients is at stake, the eyes of both parties may be seriously fatigued by flashes that these lighting systems produce. On the other hand, these LED-based lighting systems are likely to produce flashes or stripes on the monitor used by medical institutes or surgeons for observing surgical procedures from time to time. In view of the above, the disadvantageous flashes resulted from the technique of driving current LEDs have become an urgent problem waiting to be addressed.

SUMMARY

To solve such problem, the present invention provides an LED driver circuit, comprising: a voltage converter electrically connected to a power supply and an LED string, wherein the voltage converter provides a fixed voltage to the LED string; and a current-based light-adjusting unit electrically connected to the voltage converter, wherein the current-based light-adjusting unit controls the amplitude of the current flowing through the LED string, in an analog manner and based on a duty cycle of a pulse width modulation signal.

The present invention also provides a method for driving an LED, comprising: providing a fixed voltage to the LED string, and controlling, in an analog manner and based on a duty cycle of a pulse width modulation signal, the amplitude of the current flowing through the LED string.

In the present invention, a fixed voltage is provided to an LED string by a voltage converter, wherein a pulse width modulation signal is received through a current-based light-adjusting unit and the amplitude of the current flowing through the LED string is controlled in an analog manner and based on a duty cycle of the pulse width modulation signal. These features aim at overcoming the disadvantage of LED flashes resulted from current methods for driving LEDs.

DETAILED DESCRIPTION

Figure 1:
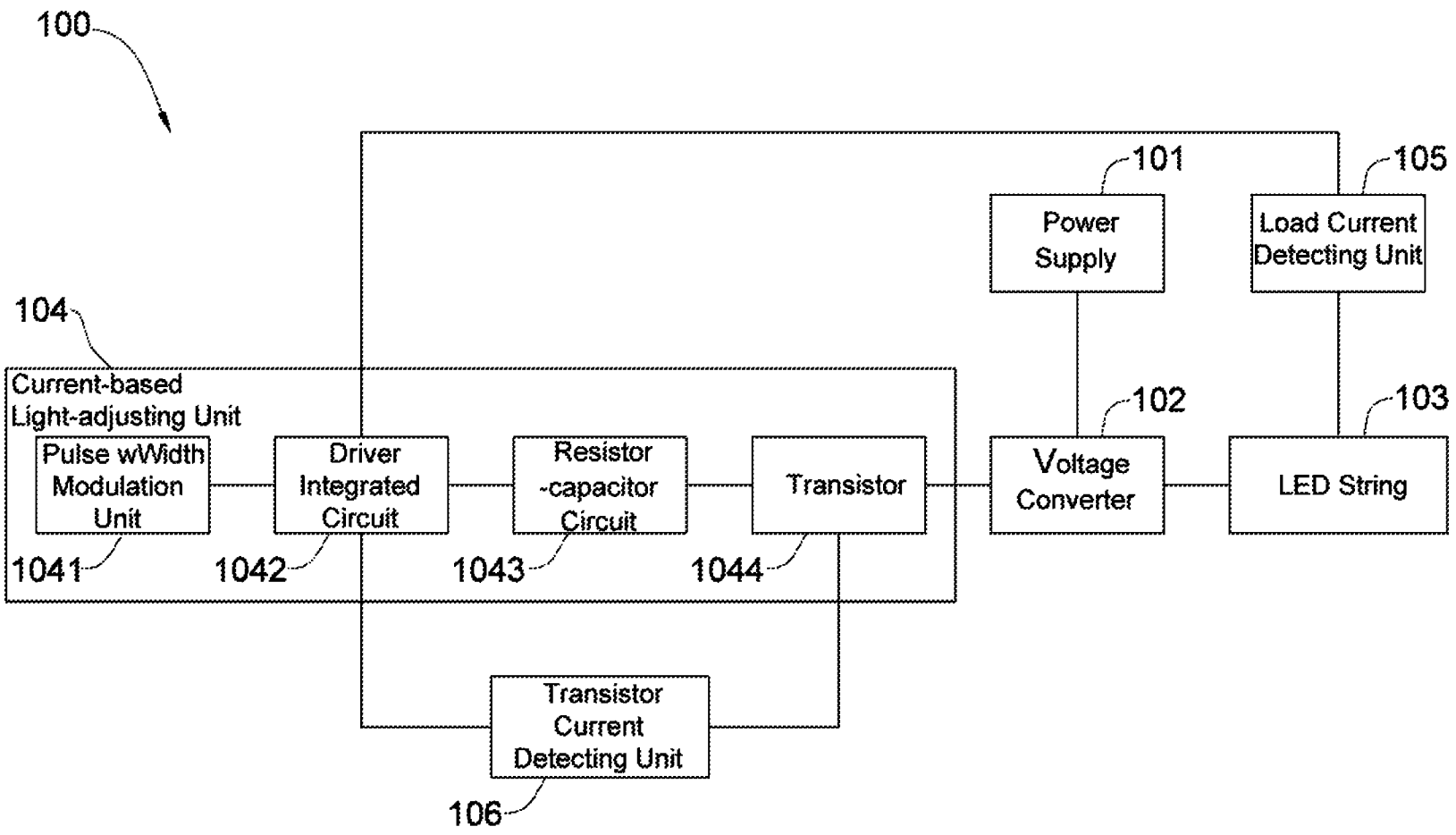
FIG. 1 is a block diagram that schematically shows an LED driver circuit of the present invention.

Several exemplary embodiments of the present invention are detailed as below. It shall be noted that these embodiments are disclosed merely for the purpose of illustrating the general principles of the invention. The scope of the invention is defined by the appended claims, rather than limited to the embodiments disclosed herein that contain specific features, structures or characteristics. In addition, all unnecessary features are not shown in any of the accompanying drawings, and the elements shown therein may also be simplified in illustrative displays. Furthermore, dimensions of the elements may be exaggerated or not to scale in the drawings for clarity of illustration. Despite the degree of simplification in the drawings, or whether or not relevant features are thoroughly described, all illustrations and descriptions fall within the scope in which they could be achieved by a person skilled in the art based on the embodiments described herein and other embodiments that include related features, structures and characteristics.

Figure 2:
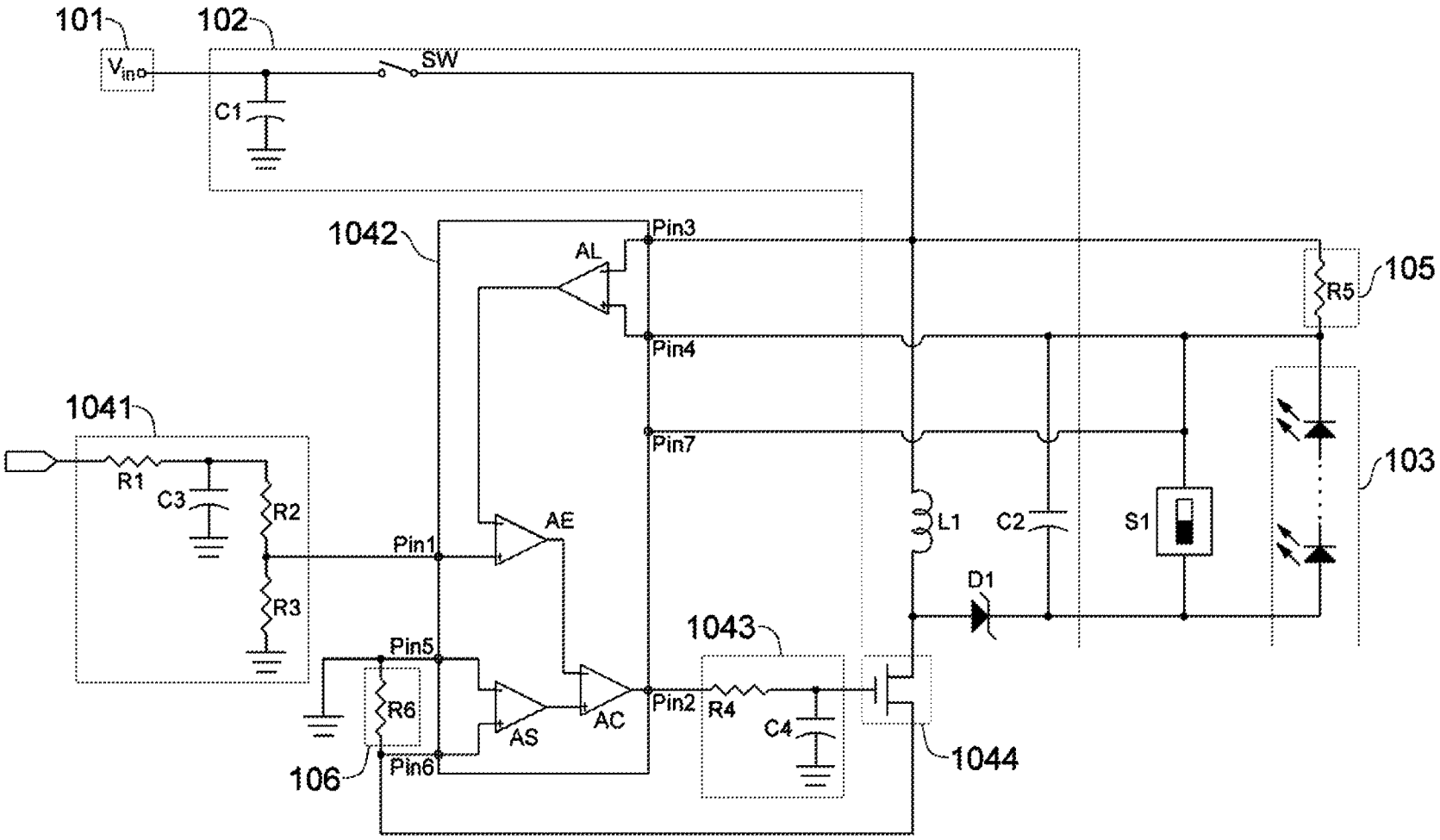
FIG. 2 is a circuit diagram of an LED driver circuit according to one embodiment of the present invention.

FIG. 1 is a block diagram that schematically shows an LED driver circuit 100 of the present invention, and FIG. 2 is a circuit diagram of an LED driver circuit according to one embodiment herein. As shown in FIG. 1, the LED driver circuit 100 comprises a power supply 101, a voltage converter 102, an LED string 103 and a current-based light-adjusting unit 104. The voltage converter 102 is electrically connected to the power supply 101 and the LED string 103, wherein the voltage converter 102 provides a fixed voltage to the LED string 103. In one embodiment of the present invention, as shown in FIG. 2, the voltage converter 102 is a DC/DC converter as well as a buck-boost converter, and comprises a capacitor C1, a switch SW, an inductor L1, a Zener diode D1 and a capacitor C2. The LED string 103 is disposed at both terminals of the capacitor C2, and the voltage converter 102 receives an input direct voltage Vin in order to provide a fixed direct voltage to both terminals of the LED string 103.

Further, as shown in FIG. 1, the current-based light-adjusting unit 104 is electrically connected to the voltage converter 102. The current-based light-adjusting unit 104 receives a pulse width modulation signal (not shown) and controls the amplitude of the current flowing through the LED string 103, in an analog manner and based on a duty cycle of the pulse width modulation signal. Precisely, the current-based light-adjusting unit 104 comprises a pulse width modulation (PWM) unit 1041, a driver integrated circuit (IC) 1042, a resistor-capacitor circuit (RC circuit) 1043 and a transistor 1044. In one embodiment of the present invention, also shown in FIG. 2, the PWM unit 1041 is electrically connected to the driver IC 1042, receives a pulse width modulation signal, converts the pulse width modulation signal to an analog signal, and sends the analog signal to the driver IC 1042, wherein the amplitude of the analog signal is dependent on the duty cycle of the pulse width modulation signal. The PWM unit 1041 comprises a resistor R1, a capacitor C3, a resistor R2 and a resistor R3, wherein a first terminal of the resistor R1 receives the pulse width modulation signal; a second terminal of the resistor R1 is electrically connected to a first terminal of the capacitor C3 and to a first terminal of the resistor R2; a second terminal of the capacitor C3 is electrically connected to ground; a second terminal of the resistor R2 is electrically connected to Pin 1 of the driver IC 1042 and to a first terminal of the resistor R3; and a second terminal of the resistor R3 is electrically connected to ground. In other words, the voltage signal sent from the resistor R3 is said analog signal.

The driver IC 1042 is electrically connected to a gate terminal of the transistor 1044 through the RC circuit 1043 composed of a resistor R4 and a capacitor C4. A drain terminal of the transistor 1044 is electrically connected to a load circuit of the voltage converter 102, that is, electrically connected between the inductor L1 and the Zener diode D1. A source terminal of the transistor 1044 is electrically connected to ground. The driver IC 1042, based on the amplitude of the analog signal, sends out a signal from pin 2 and provides an analog voltage to the gate terminal of the transistor 1044 through the RC circuit 1043. The driver IC 1042 thereby controls the current flowing through the transistor 1044 to shunt the load circuit and achieve the effect of controlling the value of the current flowing through the LED string 103 or the amplitude of the current.

As shown in FIGS. 1 and 2, the LED driver circuit 100 of the present invention comprises a load current detecting unit 105 and a transistor current detecting unit 106. The load current detecting unit 105 is used for detecting the value of the current flowing through the LED string 103 or the amplitude of the current, and the transistor current detecting unit 106 is used for detecting the value of the current flowing through the transistor 1044 or the amplitude of the current. In a preferred embodiment of the present invention, the load current detecting unit 105 is a resistor R5 in the load circuit, wherein a first terminal of the resistor R5 is electrically connected to Pin 3 of the driver IC 1042, and a second terminal of the resistor R5 is electrically connected to Pin 4 of the driver IC 1042 and to the LED string 103. The transistor current detecting unit 106 is a resistor R6 used for shunting the load circuit, wherein a first terminal of the resistor R6 is electrically connected to Pin 5 of the driver IC 1042 and to ground, and a second terminal of the resistor R6 is electrically connected to Pin 6 of the driver IC 1042 and to the source terminal of the transistor 1044. The values of the currents flowing through the LED string 103 and the transistor 1044 are converted by the resistors R5 and R6 to voltage signals, respectively, and the signals are then received by the driver IC 1042.

The driver IC 1042 comprises an amplifier AL, an amplifier AS, an error amplifier AE, and a comparator AC. The negative terminal and positive terminal of the amplifier AL are electrically connected to Pin 3 and Pin 4 of the driver IC 1042, respectively, which means the amplifier AL is connected across both terminals of the resistor R5. The negative terminal and positive terminal of the error amplifier AE are electrically connected to the output of the amplifier AL and to Pin 1 of the driver IC 1042, respectively. The negative terminal and positive terminal of the amplifier AS are electrically connected to Pin 5 and Pin 6 of the driver IC 1042, respectively, which means the amplifier AS is connected across both terminals of the resistor R6. The outputs of the amplifier AS and the error amplifier AE are electrically connected to the negative terminal and positive terminal of the comparator AC, respectively. The output of the comparator AC is electrically connected to Pin 2 of the driver IC 1042, in order to provide an analog voltage to the gate terminal of the transistor 1044 through the RC circuit 1043. Therefore, based on the amplitude of the analog signal received at Pin 1, the amplitude of the current flowing through the LED string 103 and the amplitude of the current flowing through the transistor 1044, the driver IC 1042 sends out a signal from Pin 2 and provides an analog voltage to the gate terminal of the transistor 1044 through the RC circuit 1043, so as to enable the transistor 1044 to generate currents, thereby controlling the value of the current flowing through the LED string 103. In one embodiment of the present invention, the driver IC 1042 sends out a PWM signal, whose duty cycle responds to the amplitude of the analog signal received at Pin 1.

In an alternative embodiment of the present invention, the LED driver circuit 100 further comprises a dip switch S1, whose both terminals are electrically connected to both terminals of the LED string 103, respectively, and one terminal is electrically connected to Pin 4 and Pin 7 of the driver IC 1042. The driver IC 1042 determines the status of the dip switch S1 based on the electrical potential at Pin 7, thereby determining the number of LEDs in the LED string 103. In this embodiment, the LED string may be composed of 6 or 8 LEDs, and the choice of dip switch Si determines whether 6 or 8 LEDs are to be included in the LED string 103 for the LED driver circuit 100.

Preferred embodiments of the present invention have been detailed in the descriptions above as well as in the accompany drawings. All the features disclosed herein may be combined using other methods, and each of the features may be replaced by those that are identical, equivalent or fulfilling similar purposes. In this regard, the features disclosed herein, except for prominent ones, represent one example among a series of equivalent or similar features.

Based on the detailed descriptions of the preferred embodiments of the present invention, a person skilled in the art would clearly appreciate that various alterations and changes could be made without departing from the spirit and scope of the invention and are all included in the protection scope of the appended claims. Also, the present invention is not limited to the methods in the embodiments mentioned herein.

What is claimed is:

1. An LED driver circuit, comprising:

a voltage converter electrically connected to a power supply and an LED string, wherein the voltage converter provides a fixed voltage to the LED string; and a current-based light-adjusting unit electrically connected to the voltage converter, wherein the current-based light-adjusting unit controls the amplitude of a current flowing through the LED string, in an analog manner and based on a duty cycle of a pulse width modulation signal.

2. The LED driver circuit of claim 1, wherein the current-based light-adjusting unit comprises a pulse width modulation unit for receiving the pulse width modulation signal and converting the pulse width modulation signal to an analog signal whose amplitude is dependent on the duty cycle of the pulse width modulation signal.

3. The LED driver circuit of claim 2, wherein the current-based light-adjusting unit comprises a transistor whose first terminal is electrically connected to a load circuit of the voltage converter and whose second terminal is electrically connected to ground, a voltage value on a gate terminal of the transistor being dependent on the amplitude of the analog signal.

4. The LED driver circuit of claim 3, further comprising:

a load current detecting unit detecting the amplitude of the current flowing through the LED string; and a transistor current detecting unit detecting the amplitude of the current flowing through the transistor, wherein the voltage value on the gate terminal is dependent on the amplitudes of the analog signal, of the current flowing through the LED string and of the current flowing through the transistor.

5. The LED driver circuit of claim 4, wherein the current-based light-adjusting unit comprises a driver integrated circuit which is electrically connected to the pulse width modulation unit, the load current detecting unit and the transistor current detecting unit, and the current-based light-adjusting unit sends out an output signal based on the amplitudes of the analog signal, of the current flowing through the LED string and of the current flowing through the transistor, the output signal having a duty cycle which responds to the amplitude of the analog signal.

6. The LED driver circuit of claim 5, wherein the output signal of the driver integrated circuit is connected to the gate terminal of the transistor through a RC circuit, so that the current-based light-adjusting unit controls, in an analog manner, the amplitude of the current flowing through the LED string by driving the transistor.

7. The LED driver circuit of claim 1, wherein the pulse width modulation unit comprises a first resistor, a capacitor, a second resistor and a third resistor, wherein a first terminal of the first resistor receives the pulse width modulation signal, a second terminal of the first resistor is electrically connected to a first terminal of the capacitor and to a first terminal of the second resistor, a second terminal of the capacitor is connected to ground, a second terminal of the second resistor is electrically connected to the driver integrated circuit and to a first terminal of the third resistor, and a second terminal of the third resistor is connected to ground.

8. A method for driving LEDs, comprising:

providing a fixed voltage to an LED string; and controlling, in an analog manner and based on a duty cycle of a pulse width modulation signal, the amplitude of a current flowing through the LED string.

9. The method for driving LEDs of claim 8, wherein controlling the amplitude of the current flowing through the LED string, in an analog manner and based on a duty cycle of a pulse width modulation signal, includes:

receiving the pulse width modulation signal and converting the pulse width modulation signal to an analog signal whose amplitude is dependent on the duty cycle of the pulse width modulation signal.

10. The method for driving LEDs of claim 9, wherein controlling the amplitude of the current flowing through the LED string, in an analog manner and based on a duty cycle of a pulse width modulation signal, includes:

electrically connecting a first terminal of a transistor to a load circuit related to the LED string; and electrically connecting a second terminal of the transistor to ground, wherein a voltage value on a gate terminal of the transistor is dependent on the amplitude of the analog signal.

11. The method for driving LEDs of claim 10, wherein controlling the amplitude of the current flowing through the LED string, in an analog manner and based on a duty cycle of a pulse width modulation signal, includes:

detecting the amplitude of the current flowing through the LED string; and detecting the amplitude of the current flowing through the transistor, wherein the voltage value on the gate terminal is dependent on the amplitudes of the analog signal, of the current flowing through the LED string and of the current flowing through the transistor.

* * * * *